US006109886A

United States Patent [19]

Schonfeld et al.

[11] Patent Number: 6,109,886

[45] Date of Patent: Aug. 29, 2000

[54] COMPRESSED-AIR SUPPLY INSTALLATION WITH REDUCED IDLING POWER

[75] Inventors: Kark Heinrich Schonfeld, Seelze, Germany; Folkhard Hölzel, Johns Island, S.C.

[73] Assignee: WABCO GmbH, Hannover, Germany

[21] Appl. No.: 09/164,463

[22] Filed: Oct. 1, 1998

Related U.S. Application Data

[63] Continuation-in-part of application No. 08/949,789, Oct. 14, 1997, abandoned.

[30] Foreign Application Priority Data

Oct. 2, 1997 [DE] Germany ..... 197 43 593

[51] Int. Cl.[7] ..... F04B 49/00

[52] U.S. Cl. ..... 417/298; 417/306; 417/364; 417/440

[58] Field of Search ..... 417/306, 364, 417/298, 440

[56] References Cited

U.S. PATENT DOCUMENTS 4,459,085 7/1984 Tonegawa ..... 417/298
5,101,857 4/1992 Herger et al. .
5,584,673 12/1996 Rein ..... 417/308

FOREIGN PATENT DOCUMENTS 153728 7/1938 Austria .
1528589 1/1970 Germany .
4438827 12/1996 Germany .

*Primary Examiner*—Charles G. Freay
*Assistant Examiner*—Cheryl J. Tyler
*Attorney, Agent, or Firm*—Proskauer Rose LLP

[57] ABSTRACT

A compressed air installation having a normal operating mode and an idling mode includes a feed valve, a feed line which is connected to and receives air through the feed valve, at least one compressor having at least one compression chamber, and at least one inlet valve which is connected to the feed line and supplies air to the compression chamber. The feed valve and the inlet valve are switchable between open positions and one-way positions wherein air can pass through the valve in one direction only. In normal operating mode, the feed valve is in its open position and the inlet valve is in its one-way position, thereby allowing air to enter and exit the installation through the feed valve and the feed line, and to pass from the feed line through the inlet valve into the compression chamber. When the compressed air supply installation is in idling mode, the inlet valve is in its open position and the feed valve is in its one-way position, thereby allowing air to enter the installation through the feed valve and into the feed line, and to enter and exit the compression chamber through the feed line. In a first alternative embodiment, the feed valve is switchable between open and closed positions, while the inlet valve is switchable between a one-way position in normal operating mode and an open position in idling mode.

31 Claims, 9 Drawing Sheets

COMPRESSED-AIR SUPPLY INSTALLATION WITH REDUCED IDLING POWER

This application is a continuation-in-part of application Ser. No. 08/949,789, which was filed on Oct. 14, 1997, now abandoned.

BACKGROUND OF THE INVENTION

The present invention relates to a compressed-air supply installation having a normal operating mode and an idling mode in which the installation consumes less power. Such installations have a compression chamber or chambers connected through one or more inlet valves to a feed line. An installation of this type is disclosed in U.S. Pat. No. 5,101,857 (DE 39 04 172 A1). In normal operation, the inlet valve allows the compression chamber to fill through the feed line but prevents air from returning back to the feed line during and after compression. When the installation is in its idling mode, however, the inlet valve allows air to flow in and out of the compression chamber into and through the feed line.

In U.S. Pat. No. 5,101,857, the inlet valve has a vane that swivels or slides in response to a drive arrangement. This drive arrangement holds the valve vane in an open position while the compressed-air supply installation remains in its idling mode. While the installation delivers no compressed air into the downstream compressed-air actuated installation, it continues to consume some power even in its idling mode. A part of this idling power occurs because the compressor moves an air volume approximating the maximum size of the compression chamber back and forth through the open inlet valve and into and through the feed line. This air movement has associated flow losses that make substantial contributions to the power consumed by the installation in its idling mode.

The flow losses are even greater, and the compressed-air supply installation consumes correspondingly more power while idling, when the air in the feed-line is pre-compressed. This is the case, for example, when the feed line is connected to the inlet line of a supercharged combustion engine downstream of the supercharger (which may be a turbocharger). This arrangement is commonly used in vehicles with supercharged engines. The greater flow losses are caused in these cases by the increased density of the pre-compressed air.

Accordingly, the general object of the present invention is to reduce the power consumption of an idling compressed-air supply installation in a simple way. It is another object of the invention to reduce the idling power consumption when the feed line is connected downstream of a supercharger.

SUMMARY OF THE INVENTION

In accordance with the present invention, a compressed-air supply installation that has a normal operating mode and an idling mode comprises a feed valve, a feed line connected to the feed valve, at least one inlet valve connected to the feed line, and at least one compressor containing at least one compression chamber connected to the inlet valve. The feed valve is in an open position and the inlet valve is in a one-way (check-valve) position in the normal operating mode. This allows air to enter and exit the compressed-air supply installation through the feed valve and the feed line and to pass from the feed line through the inlet valve into the compression chamber. However, the air in the compression chamber cannot return through the inlet valve and is forced through an outlet check valve instead.

In the idling mode, the inlet valve is in an open position and the feed valve is in a check-valve position. In these positions, the valves allow air to enter the installation through the feed line and to pass back and forth between the feed line and the compression chamber. In effect, the feed line and the compression chamber form an enlarged compression chamber. The compressor continues to compress the air in this enlarged compression chamber in its idling mode. However, the flow of air back and forth from the compression chamber into the feed line is not as great as in prior-art installations, and the reduced flow losses are reflected in reduced power consumption of the compressor. Furthermore, most of the work that the compressor performs on the air in the enlarged compression chamber is regained during the return expansion. The fact that the compressor continues to compresses air while idling also advantageously reduces oil consumption.

When the compressed-air supply installation receives input air from a supercharger of a combustion engine as is usual in automotive applications, the feed valve is closed in the idling mode. Excess air in the enlarged compression chamber is allowed to flow out of the installation through a branch line connecting the feed line to a switch valve. The air flowing out through the switch valve can be throttled or regulated so that the air pressure remaining in the enlarged compression chamber is large enough to prevent excessive oil consumption and small enough to prevent excessive power consumption in the idling mode.

A less expensive solution is achieved by replacing the switchable valve in or at the end of the branch line with a throttle effect. This effect can be realized in the branch line itself, a throttle component, or a regulating valve with a predetermined opening pressure.

The organization and operation of this invention will be understood from a consideration of detailed descriptions of illustrative embodiments, which follow, when taken in conjunction with the accompanying drawings.

DETAILED DESCRIPTION OF THE INVENTION

Figure 1:
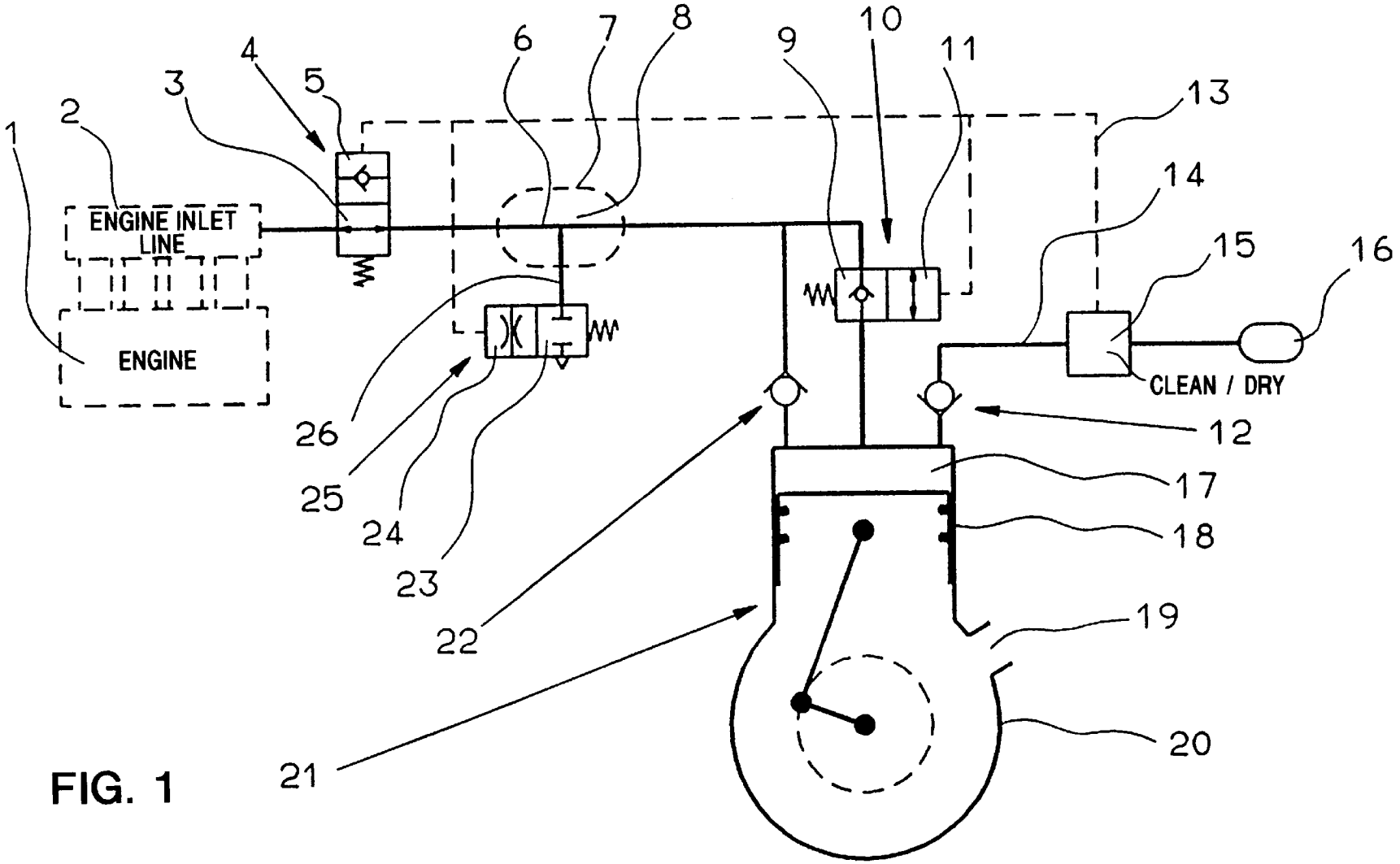
FIG. 1 is a schematic diagram of a first embodiment of the inventive compressed-air supply installation showing a particular set of valving operations at inlet and feed valves and at an additional valve connected to the feed line through a branch line.

FIG. 1 shows the basic design of the compressed-air supply installation, which incorporates a single-cylinder compressor (21) having an inlet valve (10) and an outlet valve (12). The compressor (21) accepts air from a feed line (6) through the inlet valve (10) and delivers compressed air to an outlet line (14) through the outlet valve (12).

In FIG. 1, air enters the installation upstream from the feed valve (4) at the end of the feed line (6) away from the compressor (21). However, the feed valve (4) can also be installed at the end of the feed line away from the compressor (21), in which case air enters the installation at the inlet of the feed valve (4). Upstream of the feed valve (4) or at the latter's inlet, respectively, the feed line (4) is open to the atmosphere. In automotive technology, it is customary to have the feed line (6) accept air at the inlet line (2) of the combustion engine (1) serving to drive the vehicle, which are indicated by broken lines in FIG. 1.

The outlet line (14) carries compressed air to an installation (15, 16) where air consumers (e.g., operating cylinders) use the compressed air to perform specific operations. FIG. 1 represents this installation (15, 16) schematically by an air-preparation device (15) and a compressed-air storage tank (16). The air preparation device (15) comprises known devices for cleaning and drying the compressed air. Depending on the specific application, the air-preparation device (15) may also contain devices for safety, locking, protection and monitoring. As is customary, a pressure sensor (not separately shown) is also provided at an appropriate location of compressed-air actuated installation (15, 16) to monitor its pressure. In FIG. 1, this pressure sensor is assumed to belong to the air-preparation device (15). This pressure sensor transmits an idling control signal to a control line (13) in the compressed-air supply installation indicated by broken lines in FIG. 1. This idling control signal is generated when the pressure of the compressed-air actuated installation (15, 16) reaches a desired switch-off pressure and is maintained until the pressure drops to a predetermined lower switch-on pressure.

The feed valve (4) has an open position (3), a check-valve position (5) and an actuator that is connected to the control line (13) coming from the pressure sensor. In the absence of the control signal, the feed valve (4) automatically resets to its open position (3) e.g., by means of a spring. Upon receiving an idling control signal from the pressure sensor, the actuator sets the feed valve (4) to its check-valve position (5). In this position the feed valve (4) allows air to flow into the feed line (6) towards the compressor (21), but air returning from the compressor (21) cannot pass through the feed valve to exit from the installation.

The inlet valve (10) of the compressor (21) has a check-valve position (9) and an open position (11) and an actuator that is also connected to the control line (13). In the absence of the idling control signal, the inlet valve (10) automatically resets to its check-valve position (9), e.g., by spring return. Upon receiving an idling control signal from the pressure sensor, the actuator sets the inlet valve (10) to its open position (11).

When the compressor (21) is in its normal operating mode, the feed valve (4) is in its open position (3) and the inlet valve (10) is in its check-valve position (9). As the compression chamber (17) expands, air is pulled in through the feed valve (4), passes through the feed line (6) and enters the compression chamber (17) via the inlet valve (10). As the compression chamber contracts, this air is delivered through an outlet check-valve (12) into the outlet line (14) and is delivered into the compressed-air actuated installation (15, 16).

The compressor switches from normal operation to idling in response to the idling control signal. The pressure sensor in the air-preparation device (15) sends the idling control signal through the control line (13) when the pressure in the compressed-air actuated installation reaches the desired switch-off value. The idling control signal then switches the inlet valve (10) to its open position (11) and the feed valve (4) to its check-valve position (5). As the volume of the compression chamber (17) decreases in idling mode, air flows through the open inlet valve (10) into the feed line (6). However, the feed valve (4) is closed for air returning through the feed line (6) from the inlet valve (10). Consequently, the volume of the feed line (6) between the inlet valve (10) and the feed valve (4), in effect, enlarges the compression chamber (17). The pressure in this enlarged compression chamber reaches a so-called "idling self-stabilizing" pressure at maximum compression. No air flows into the compressed-air actuated installation (15, 16) through the outlet valve (12) in idling mode. This is so because the actual pressure in the compressed-air actuated installation (15, 16) keeps the outlet valve (12) closed or, according to the installation layout, because of a particular locking valve in the air-preparation device (15). The idling self-stabilizing pressure will be lower than the maximum air pressure that occurs in the compression chamber (17) in the normal operating mode because the enlarged compression chamber results in a reduced compression ratio.

The compressor (21) continues to compress the air in the enlarged compression chamber in idling mode. However, the power consumed by the compressor is reduced compared to that of the compressor in the installation disclosed in U.S. Pat. No. 5,101,857. This reduction occurs because during the compression only a small air volume is exchanged between the compression chamber (17) and the feed line (6) with accordingly small flow losses. The compression work done by the compressor on the air in the enlarged compression chamber is regained during the re-expansion with the exception of a minimal work loss that occurs because of thermal loss.

The fact that the compressor continues to compress air while idling also advantageously reduces oil consumption. Prior art embodiments, including U.S. Pat. No. 5,101,857, consume more oil while idling because the air pressure in the compression chamber (17) drops below the air pressure in the crank case (20) as the compression chamber expands. Consequently, oil enters the compression chamber (17) in spite of the usual sealing elements of the compressor piston (18). This oil then escapes with the compressed air through the outlet valve (12) into the compressed air actuated installation (15, 16). In the inventive installation, however, the air pressure in the compression chamber (17) remains above that in the crankcase (20), even during the return expansion phase. As a result, oil leakage is reduced, although it cannot be avoided completely.

It may occur that in the idling mode, due to leakage of the sealing elements of the compressor piston (18) and/or of the feed valve (4) as well as of the outlet valve (12), air may escape from the enlarged compression chamber. The permeability of the feed valve (4) in its idling check-valve position (5) in the direction of the compressor (21) makes a replacement of the escaped air volume possible. Consequently, the described action of the compressor (21) in its idling mode remains the same and the resulting advantages are always assured.

The valves shown in FIG. 1, and in the other drawings as well, are indicated by basic and functional symbols in accordance with international standard ISO 1219. Embodiments of such valves are commonly known by persons schooled in the art or can be made by such persons without difficulty. The inlet valve, with its swiveling or sliding valve vane, and the outlet valve according to U.S. Pat. No. 5,101,857, for example, are existing structures that can be used. Also, according to ISO 1219, the actuators of the inlet valve (10) and the feed valve (4) are drawn as responsive to a pressure signal in the control line (13). As a rule, a pressure sensor that produces such a control signal is called a "governor" in the automotive industry. Nevertheless, it is obvious to one schooled in the art that control signals of other types, e.g., electrical signals, can be used with appropriately designed pressure sensors and actuators.

In addition to the basic embodiment discussed so far, FIG. 1 also shows further developments of the compressed-air supply installation. For example, an additional one-way inlet valve (22) may be provided to improve the filling of the compression chamber (17) and the volumetric efficiency of the compressor. Such an additional inlet valve could be, for example, the inlet valve of the above-mentioned U.S. Pat. No. 5,101,857 without the swiveling or sliding valve vane. It should also be noted that two or more physical valves with identical functions can be represented by any one of the valves shown in the drawings.

The value of the idling self-stabilizing pressure can be adjusted to a desired value by sizing the volume of the feed line (6) accordingly. Often this is realized by designing the feed line in part, at least, in the form of a feed chamber. A feed chamber (8) is indicated inside an enclosure (7) shown by broken lines in FIG. 1. At variance with what is shown, the feed chamber (8) is often placed inside the compressor (21), e.g., in its cylinder head.

As mentioned before, during the compression phase of the compressor (21), air may leak out of the enlarged compression chamber past the sealing elements of the compressor piston (18) and/or through the outlet valve (12) and/or the feed valve (4). To compensate for such leakage, or to prevent an excessively high pressure from building up in the compression chamber (17), a branch line (26) may be provided that connects the feed line (6) to a switch valve (25). The branch line (26) is placed downstream from the feed valve (4) and can also be connected to the feed chamber (8). The switch valve (25) can be installed either in the branch line (26) or also at its end. The concept "branch line" is understood to be functional, and the line need not be present physically but can also be integrated entirely into the switch valve (25). When the switch valve (25) is open, air in the feed line (6) can flow through the branch line (26) and escape from the installation. Air flowing through the switch valve (25) may also escape from the installation through a pressure relief chamber such as the crankcase (20) at a breather opening (19). This connection can also be made via an additional pressure relief chamber, e.g., the aerated housing of the combustion engine.

An actuator switches the switch valve (25) from a closed position (23) to a throttle position (24) in response to an idling control signal in the control line (13). As diagrammed in FIG. 1, the idling control signal is a pressure signal. In the absence of the idling control signal, the switch valve (25) is reset to its closed position (23) automatically, e.g., by the action of a spring. Thus, the switch valve (25) has no influence upon the function of the compressor (21) in its normal operating mode. However, when the actuator receives an idling control signal through the control line (13), it switches the switch valve (25) to its throttle position (24). In this position, a quantity of air that depends on the magnitude of the throttling action passes back and forth between the enlarged compression chamber and the atmosphere as the air in the enlarged compression chamber is compressed. When the magnitude of the throttling is small, a certain quantity of air flows in and out of compression chamber (17) through the feed line (6) and the branch line (26). As the magnitude of the throttling action increases, the quantity of air entering and exiting the installation decreases, but the quantity of air remaining in the expanded compression chamber increases. As a result, the self-stabilizing pressure in the expanded compression chamber also increases. Thus the value of the idling self-stabilizing pressure in the idling mode of the installation can be determined by controlling the magnitude of the throttling action.

Figure 2:
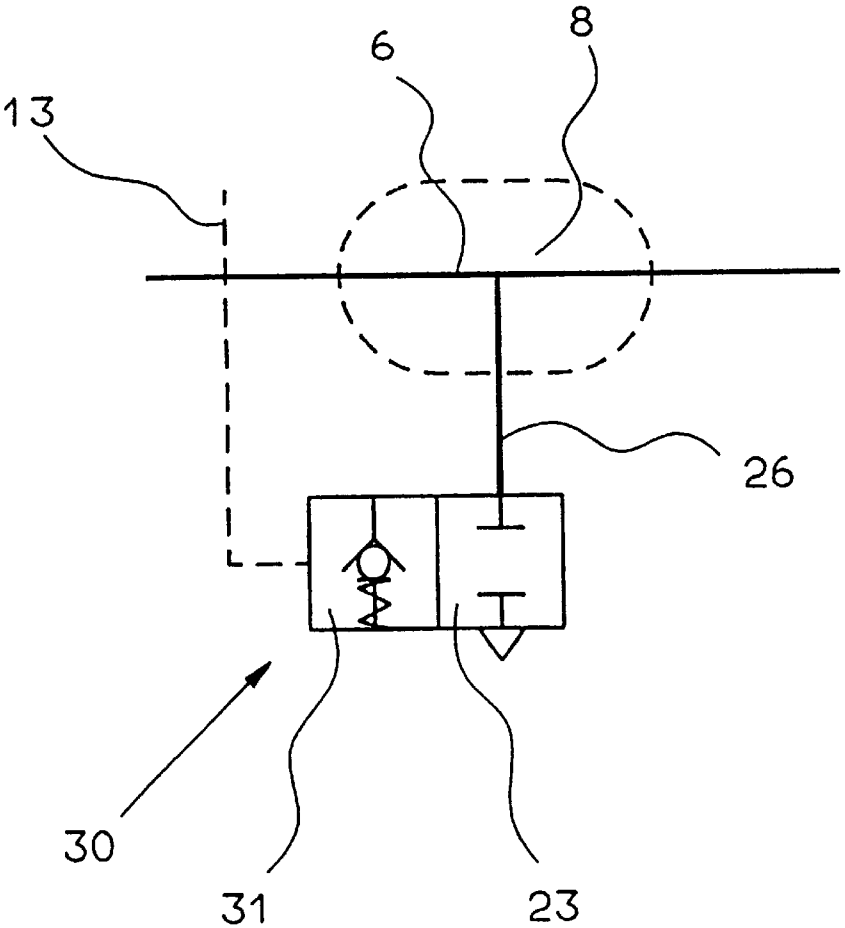
FIG. 2 is a schematic diagram of valving operations that are used in a second embodiment at the additional valve shown in FIG. 1.

FIG. 2 shows another embodiment (30) of the switch valve, which is installed in or on the branch line (26). Here the throttle position is replaced by a regulating one-way position (31) that opens at a predetermined opening pressure. In idling operation of the compressor (21), the actuator switches the switch valve (30) to this regulating one-way position (31) when the pressure in the enlarged compression chamber and hence in the branch line (26) has reached the value of the opening pressure. This allows air to escape from the enlarged compression chamber through the branch line (26) as the air is compressed but not to return when the compression chamber (17) and therewith the enlarged compression chamber expands again. Consequently, the quantity of the air in the expanded compression chamber decreases until the idling self-stabilizing pressure matches the opening pressure of the regulating one-way position (31).

Figure 3:
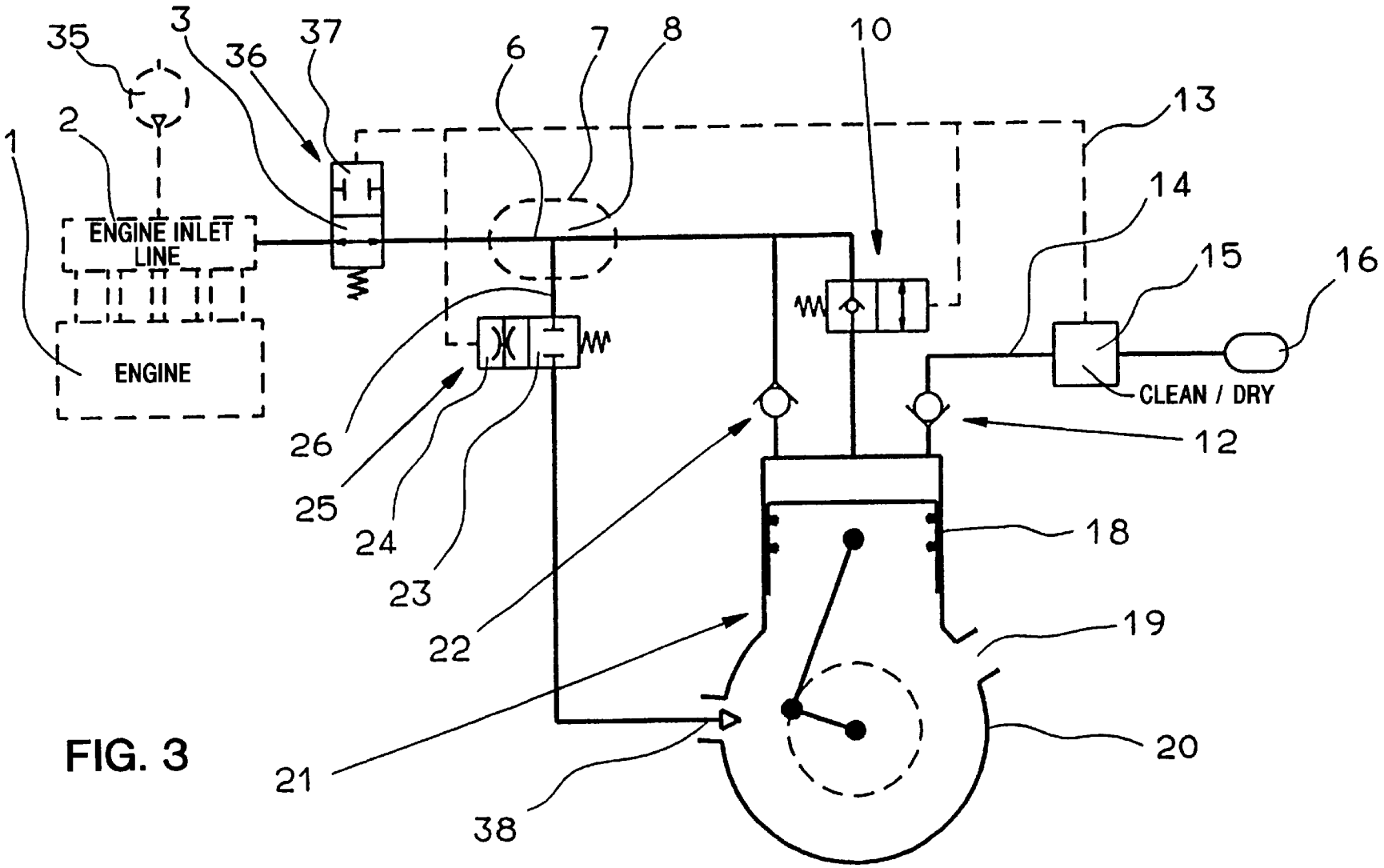
FIG. 3 is a schematic diagram of a third embodiment showing other valving operations that may be used at the feed valve and additional valve of FIG. 1.

The basic design of the compressed-air supply installation shown in FIG. 3 is identical with that shown in FIG. 1 with the exception of the feed valve (36). In this case, the feed valve (36) switches to a closed position (37) instead of a check-valve position. In the closed position this feed valve (36) closes the feed line (6) completely while the compressed-air supply installation is in its idling mode. As discussed in connection with FIG. 1, the reduced flow of air within the expanded compression chamber results in reduced power consumption by the compressor (21) in the installation's idling mode. The embodiment of FIG. 3 can also be developed further as before, whereby a branch line (26) connects the feed line (6) to switch valve (25). This switch valve is closed in the installation's normal operating mode and it permits the replacement of air which escapes from the installation in its idling mode thus reducing the lubricating oil consumption.

FIG. 3 also shows an embodiment, already mentioned in connection with FIG. 1, whereby air escaping and returning through the switch valve (25) passes through the crankcase (20) of the compressor (21). In this case, a connection (38) is provided at the crankcase (20) for the end of the branch line (26). The embodiment shown in FIG. 3 can be further developed to avoid the increase in idling power consumption that occurs when the air that enters the feed line (6) is pre-compressed as well as to maintain the advantage of reduced lubrication oil consumption. Such a case is indicated in FIG. 3 because the combustion engine (1) is charged up for increased power output, in other words, because precompressed air is fed into its inlet line (2) to which the feed line (6) is connected. The pre-compression is done by a supercharger (35).

Figure 4:
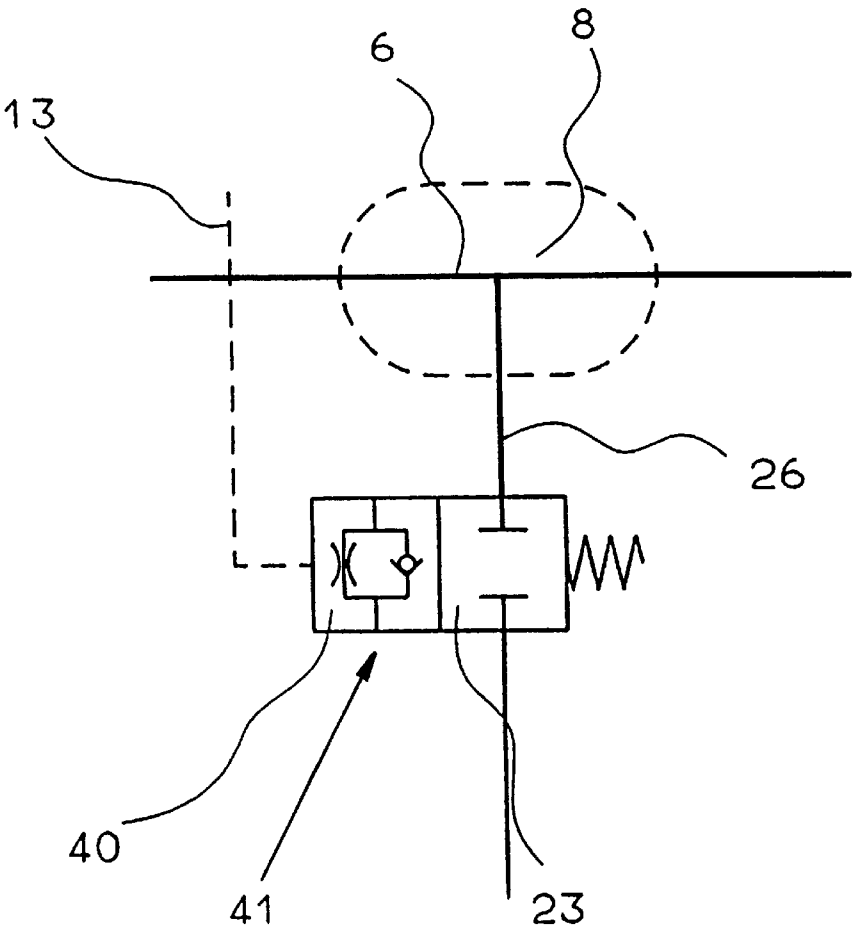
FIG. 4 is a schematic diagram of a fourth embodiment showing other valving operations that may be used at the additional valve shown in FIG. 3.
Figure 5:
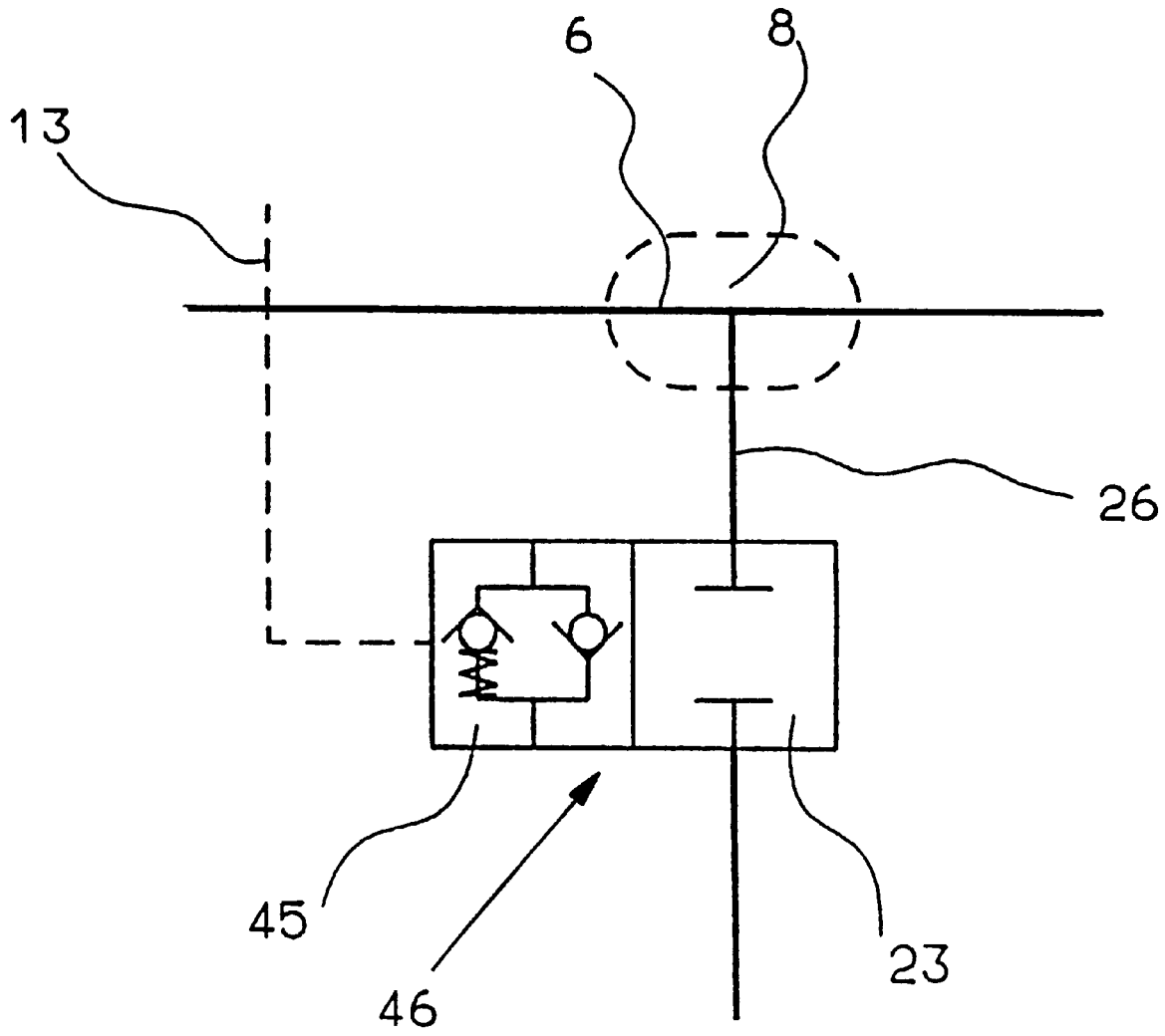
FIG. 5 is a schematic diagram of a fifth embodiment showing still other valving operations that may be used at the additional valve shown in FIG. 3.

FIGS. 4 and 5 show switch valves (41 or 46) which are suitable for such cases. In the switch valve (41) of FIG. 4, the throttling position shown in FIG. 3 is replaced by a one-way throttling position (40) in which the switch valve (41) is open without obstruction to a flow from the atmosphere to the feed line (6) and thereby to the enlarged compression chamber and in which position it is open but throttled for the flow of air that escapes as the compressor (21) pushes air through the branch line (26). According to the drawing, this latter function can be achieved by the arrangement of a check valve parallel to the throttle. The arrangement of the check valve must be such that it is open for a flow towards the feed line (6) and closed in the opposite direction.

Thanks to this design, the pre-compression pressure which may prevail in the feed line (6) and thereby in the enlarged compression chamber when the compressor is shifted to the idling mode can be reduced through the throttled opening of the switch valve (41) during the idling mode. Thereby the throttle effect contributes in determining, or determines, the value of the idling self-stabilizing pressure by itself, depending on the design of the feed line (6).

In this embodiment too, it can happen that air escapes from the enlarged compression chamber because of leaks of the type mentioned above while the compressor (21) is in its idling mode. In such case replacement air can flow rapidly from the atmosphere to the feed line (6) because the position (40) of the switch valve (41) is unobstructedly open for this direction of flow. Thus, the compression effect of the compressor (21) and thereby the reduction of lubrication oil consumption in its idling mode are maintained.

In FIG. 5 the switch valve (46) has a regulating one-way position (45) instead of the throttling position shown in FIG. 3. In this position, the switch valve (46) allows a flow from the atmosphere to the feed line (6) and thereby to the enlarged compression chamber without obstruction. For the flow in opposite direction, that means from the feed line (6) to the atmosphere, the switch valve (46) becomes open at a predetermined opening or pressure in this position. As shown in the drawing, the function can be ensured, e.g., by the parallel arrangement of two check valves, of which the one assigned to the flow from the feed line (6) into the atmosphere opens only when the opening pressure is reached in the feed line (6).

When the compressor (21) is shifted to its idling mode, this design makes possible a rapid drop of the pre-compression pressure which may prevail in the feed line (6) and thereby in the enlarged compression chamber to the above-mentioned opening pressure. The idling self-stabilizing pressure in this case is again this opening pressure. This embodiment acts like the embodiment of FIG. 4 with respect to the flow of air escaping possibly due to leakage.

It has been said above, in connection with FIGS. 2 and 5, that the opening pressure of the switch valves (30, 46) is also the idling self-stabilizing pressure. This implies that the expanded compression chamber is sized to permit the opening pressure to be reached or exceeded. Therefore, the opening pressure of the switch valves (30, 45) is the maximum self-stabilizing pressure that will be possible in these embodiments.

Figure 6:
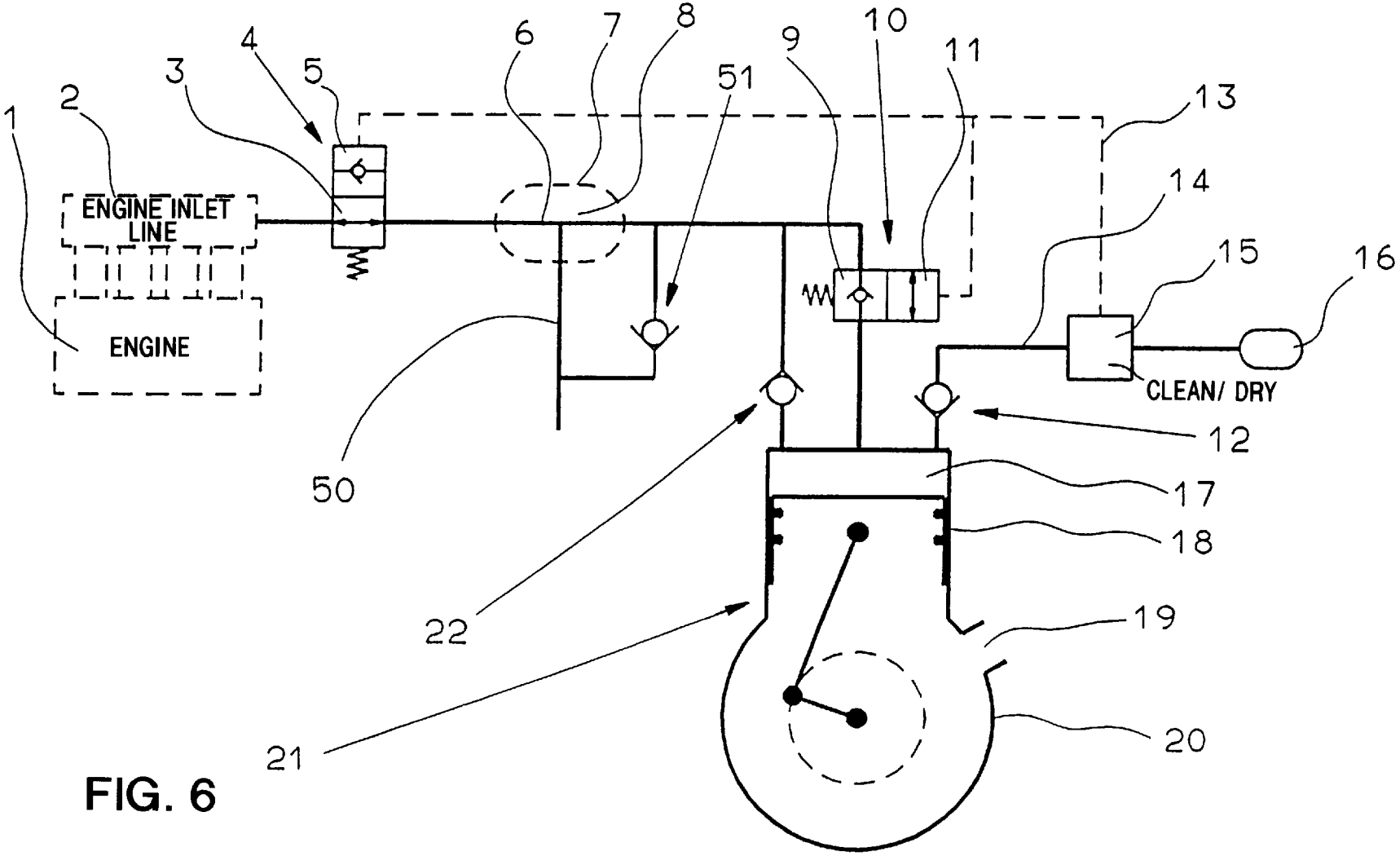
FIG. 6 is a schematic diagram of a sixth embodiment showing unswitched throttling and valving operations that may be used in the branch line of FIG. 1.
Figure 7:
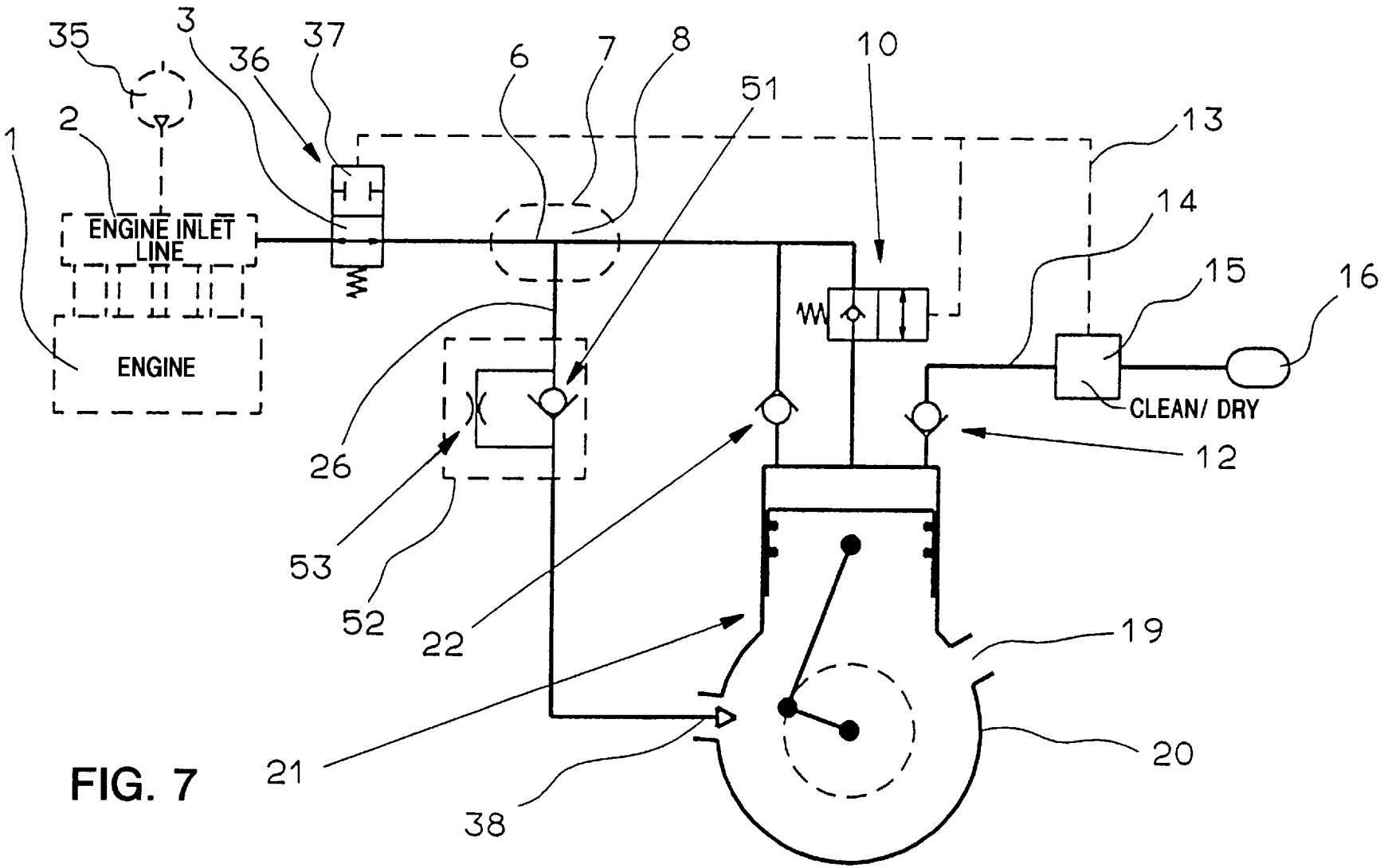
FIG. 7 is a schematic diagram of a seventh embodiment showing an alternative throttling operation that may be used in the branch line of FIG. 6.

The switch valves in the branch lines of the embodiments described above can be replaced with less-expensive components with practically the same result. Such embodiments are shown in FIGS. 6 to 10. In FIGS. 6 and 7, the switch valves (25, 30, 41, 46) of FIGS. 1 to 5 have been replaced by making the branch line in the form of a throttled channel.

In FIG. 6, the branch line (50) throttles the flow of air by virtue of its design. The relevant design parameters of the branch line (50) are its clear cross-section, length, curves, etc. In FIG. 7, a throttle (53) is inserted in the branch line (26). At variance with what is shown, the throttle (53) can also be located at the end of the branch line (26). This solution offers simple adaptations to certain applications, particularly when the throttle (53) is designed to be adjustable in a known manner.

In the idling mode of the compressed-air supply installation, the branch line (50) of FIG. 6 or (26, 53) of FIG. 7 acts like the switch valve (25) of FIGS. 1 and 3 in its throttling position (24). In the normal operating mode of the installation, the branch line (50 or 26, 53) makes a flow of air to the feed line possible and thus constitutes a branch feed line. The effect of this branch feed line must be considered when the branch line lets out directly into the atmosphere. In such cases, means like, e.g., a filter must be provided to restrict the access of polluted air through the branch line (50 or 26, 53) into the feed line (6).

In the idling mode of the compressed-air supply installation, the branch line (50 or 26, 53) acts almost as the switch valve (41) of FIG. 4 in its open position (40). The only difference consists in the fact that this switch valve (41) allows air to flow unhindered into the feed line (6) in the case of the aforementioned leakages while the branch line (50 or 26, 53) allows this flow in a throttled manner. In general, this difference has practically no effect however because the leakage of air out of the installation in its idling mode is generally minimal. In critical cases, the solutions described above in connection with FIGS. 6 and 7 can be further developed by connecting the feed line (6) via a check valve (51) to the atmosphere downstream of the feed valve (4 or 36). This check valve must be installed such that it allows air to flow in the direction of the feed line (6) and prevents air from flowing in the opposite direction. In FIGS. 6 and 7 such check valves (51) are shown installed parallel to the branch line (50) or to the throttle (53).

The check valve (51) need not be connected directly to the branch line (50) or (26, 53). It can instead be connected directly to the feed line (6) and/or may also be equipped with its own outlet into the atmosphere.

When the air supply in the feed line (6) is pre-compressed, some of this air will escape through the branch line (50) or (26, 53) when the compressed-air supply system in its normal operating mode. Contrary to this, the switch valve (41) of FIG. 4 is in its closed position (23) in the normal operating mode and does not allow pre-compressed air to escape. As a rule, however, the supercharger (35) is strong enough to maintain the pressure in the inlet line (2) of the combustion engine (1) and in the feed line (6) in spite of the flow through the branch line (50 or 26, 53). Therefore, the loss of air through the branch line (5) or (26, 53) will not significantly affect the operation of the combustion engine.

Figure 8:
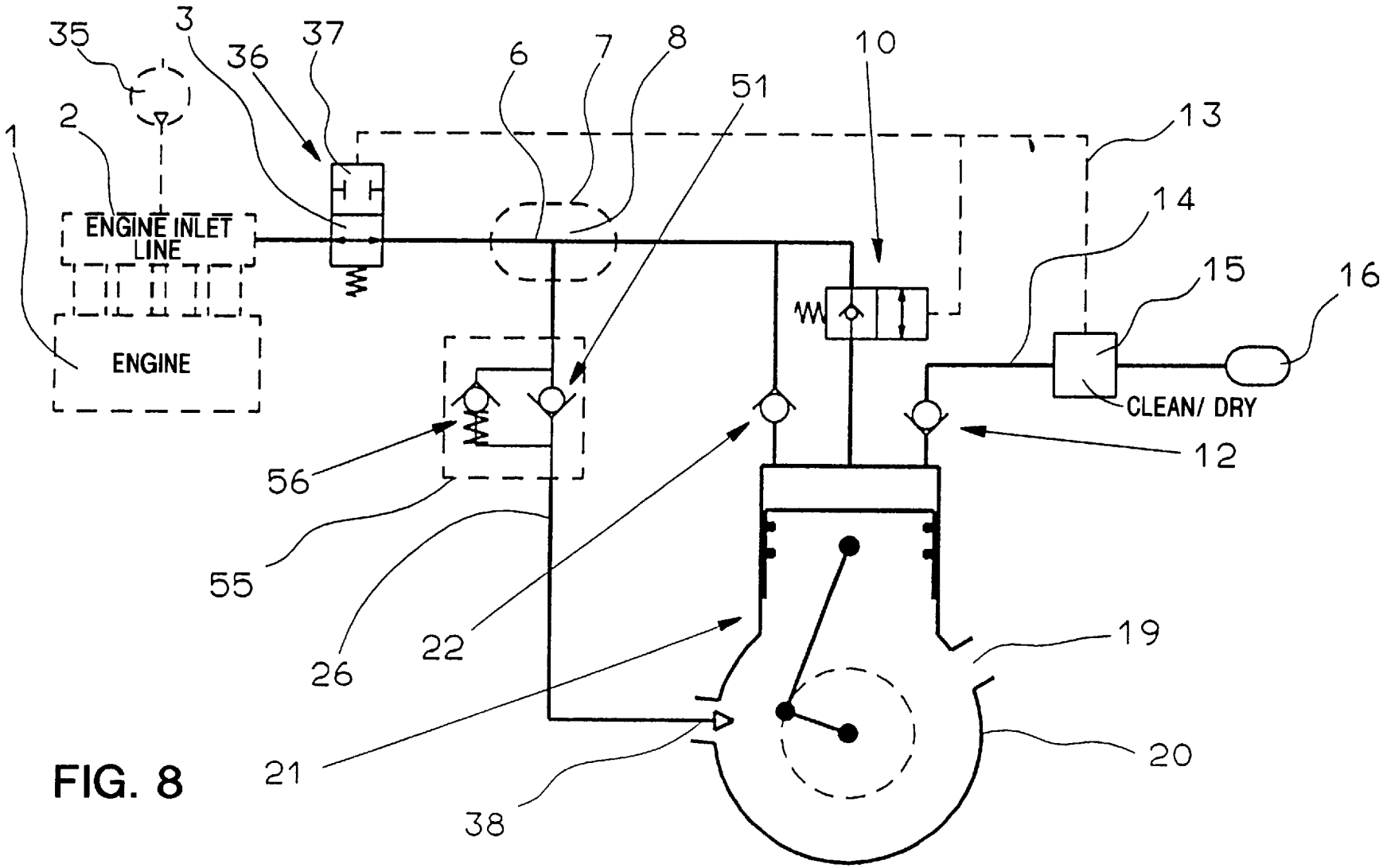
FIG. 8 is a schematic diagram of an eighth embodiment showing an alternative throttling operation that may be used in the branch line of FIG. 7.

FIG. 8 shows another less-expensive solution that is especially useful in combination with the type of feed valve (36) shown in FIG. 3. This feed valve (36) is in its closed position (37) when the compressed-air supply installation is idling. In the basic embodiment of the invention according to FIG. 8, the switch valve (25) of FIG. 3 is replaced by a check valve (51). This check valve allows air to flow in the direction of the feed line (6) but prevents a flow in the opposite direction. In the idling mode of the compressor (21) the check valve (51) closes the enlarged compression chamber in the compression phase of the compressor and permits a flow in the intake phase of the compressor (21) in case of the aforementioned leakages.

The solution according to FIG. 8 can be further developed by adding a throttle parallel to the check valve (51). This throttle is useful when the air entering the feed line (6) is pre-compressed. It is also useful when the maximum possible idling self-stabilizing pressure must be adjustable. The combination of the check-valve (51) and a throttle is shown in FIGS. 6 and 7. A still further development uses a one-way valve (56) with a predetermined opening pressure instead of a throttle as shown in FIG. 8. This arrangement allows air to exit from the feed line (6) when the opening pressure is reached without allowing air to flow back into the feed line at other times. The opening pressure of the one-way valve (56) is the maximum possible idling self-stabilizing pressure. When the air supply provided through the feed valve (36) is pre-compressed, and the installation switches to its idling mode, the pressure in the feed line rapidly drops to this maximum idling self-stabilizing pressure.

Figure 9:
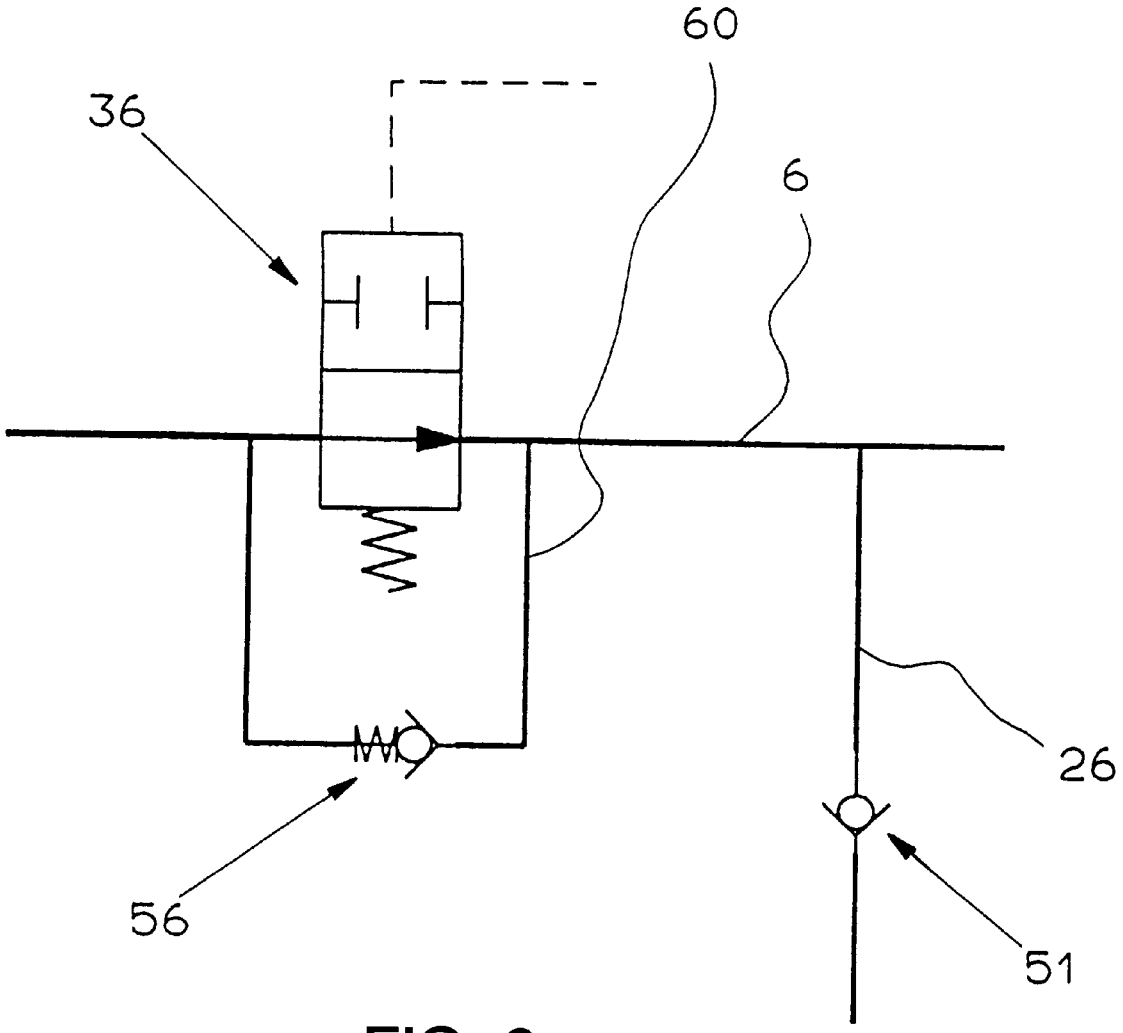
FIG. 9 is a schematic diagram of a ninth embodiment showing a one-way valve with predetermined opening pressure bypassing the feed valve instead of being placed in the branch line as in FIG. 8.

It is not necessary to connect the one-way valve with predetermined opening pressure (56) upstream and downstream of the check valve (51) as shown in FIG. 8. The inlet of the one-way valve (56) can be connected directly to the feed line (6) instead, and the one-way valve (56) may also be provided with its own outlet. FIG. 9 shows a further development in which the one-way valve (56) is located in a bypass line (56, 60) that bypasses the feed valve (36).

The one-way valve (56) in FIG. 9 is installed in the bypass line (56, 60) with its inlet connected with the outlet of the feed valve (36) and its outlet connected with the inlet of the feed valve (36). Thus when the one-way valve (56) opens, air passes from downstream of the feed valve (36) to upstream of the feed valve (36). The one-way valve (56) opens when the pressure difference between the outlet and the inlet of the feed valve (36) is equal to the predetermined opening pressure. If the maximum possible idling self-stabilizing pressure is to be the same as in the embodiment shown in FIG. 8, and if the inlet pressure at the feed valve (36) deviates from atmospheric pressure, a different design or setting of the one-way valve (36) is required. In some cases this deviation may be a negative pressure, particularly when the feed line (6) is connected to the inlet line (2) of an internal combustion engine that is not supercharged. Aside from this possibility of a negative pressure difference, the embodiments shown in FIGS. 8 and 9 are substantially the same.

In the foregoing, the term "bypass line" is primarily used to describe its function. The bypass line and one-way valve (56) may actually be physically integrated into the feed valve (36).

Figure 10:
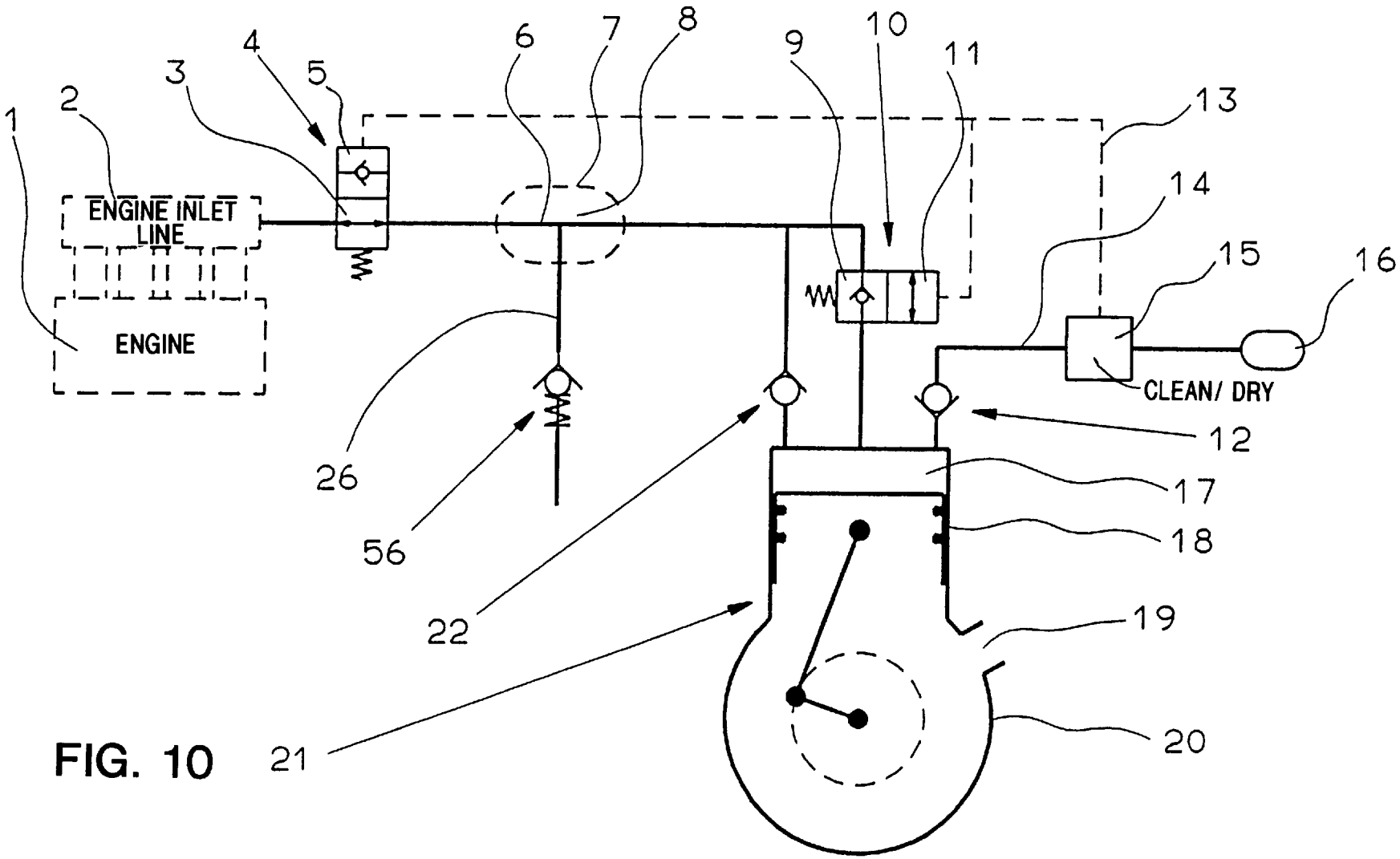
FIG. 10 is a schematic diagram of a tenth embodiment showing a one-way valve with predetermined opening pressure used in the branch line of FIG. 8 without a parallel check valve.

FIG. 10 shows yet another less costly solution. In the basic embodiment of this invention, the switch valve (25) shown in FIGS. 1 and 3 is replaced by a one-way valve, again bearing reference number (56), with predetermined opening pressure. This valve opens towards the atmosphere as soon as its opening pressure is reached in the feed line (6). When the valve opens, air escapes from the expanded compression chamber through the branch line (6). The one-way valve (56) has the same effect as the switch valve (30) of FIG. 2. That is, in the normal operating mode of the installation, the one-way valve (56) closes the branch, line (26). Then when the compressed-air supply system enters its idling mode, the opening pressure of the one-way valve (56) determines the idling self-stabilizing pressure. When the feed valve (4) of FIG. 10 is replaced by the feed valve (36) of FIG. 3 a substitution of air lost due to said leakages is not possible. For this reason, the installation may not show the advantage of reduced lubricant consumption. However, a check valve may be installed parallel to the one-way valve to allow a replenishing flow in the opposite direction. Such a further development corresponds to the solutions of the one-way valve (56) and the check valve (51) in the embodiments shown in FIGS. 8 and 9.

It should also be mentioned that the components that are enclosed by broken lines (52 and 55) in FIGS. 7 and 8 could also be integrated into a single component in each case. For example, a combination valve could be used in each case.

In all other respects, the explanations given above concerning one figure apply to all other figures directly or in corresponding fashion, insofar as no contradiction results from these explanations.

All of the above explanations also apply to a compressed-air supply installation with a multi-cylinder compressor or with several compressors each having one or more cylinders.

While the invention has been described by reference to specific embodiments, this was for purposes of illustration only. Numerous alternative embodiments will be apparent to those skilled in the art and are considered to be within the scope of the invention.

What is claimed is:

1. A compressed-air installation having a normal operating mode and an idling mode, comprising a feed valve, a feed line which is connected to said feed valve, at least one compressor having at least one compression chamber, and at least one inlet valve which is connected to said feed line and to said compression chamber, each of said feed valve and said inlet valve having an open position wherein air can pass through said valves in said open position in two directions, and a one-way position wherein air can pass through said valves in said one-way position in one direction only, wherein said feed valve is in its open position and said inlet valve is in its one-way position when said compressed-air supply installation is in said normal operating mode, thereby allowing air to enter and exit said installation through said feed valve and said feed line, and to pass from said feed line through said inlet valve into said compression chamber, and wherein said inlet valve is in its open position and said feed valve in its one-way position when said compressed-air supply installation is in said idling mode, thereby allowing air to enter said installation through said feed line, and to pass back and forth between said feed line and said compression chamber.

2. The compressed-air supply installation of claim 1 wherein said feed line includes a feed chamber.

3. The compressed air supply installation of claim 1 wherein said feed line has a predetermined volume.

4. The compressed air supply installation of claim 1 further comprising a branch line branching off from said feed line downstream of said feed valve to a switch valve which is in a closed position in said normal operating mode and in a throttling position in said idling mode, said throttling position allowing a restricted flow of air into or out of said installation through said branch line.

5. The compressed-air supply installation of claim 4 wherein said switch valve directs air entering and exiting said installation through a crankcase of said compressor.

6. The compressed air supply installation of claim 1 further comprising a branch line branching off from said feed line downstream of said feed valve to a switch valve which is in a closed position in said normal operating mode and in a regulating one-way position in said idling mode, said regulating one-way position of said additional valve allowing air to pass from said feed line through said branch line and to exit from said installation when the pressure in said feed line rises above a predetermined value.

7. The compressed air supply installation of claim 6 wherein said switch valve directs air entering and exiting said installation through a crankcase of said compressor.

8. The compressed air supply installation of claim 1, further comprising a branch line branching off from said feed line downstream of said feed valve which has a throttling effect allowing a restricted flow of air into or out of said installation through said branch line.

9. The compressed air supply installation of claim 8 wherein said throttling effect is provided by a throttle which is installed within or after said branch line.

10. The compressed air supply installation of claim 8, further comprising a check valve connected to said feed line downstream of said feed valve, wherein said check valve allows air to enter into said feed line.

11. The compressed air installation of claim 1, further comprising a branch line branching off from said feed line downstream of said feed valve and a one way valve with predetermined opening pressure which follows said branch line or is installed within said branch line, wherein said one way valve allows air to exit said branch line when the pressure in said feed line reaches said opening pressure.

12. The compressed air supply installation of claim 11, further comprising a check valve connected with said feed line downstream of said feed valve which allows air to enter said installation at said feed line.

13. The compressed air installation of claim 1, further comprising a branch line branching off from said feed line downstream of said feed valve wherein an end of said branch line towards the atmosphere lets out into the crankcase of said compressor which is connected to the atmosphere.

14. A compressed-air installation having a normal operating mode and an idling mode, comprising a feed valve, a feed line which is connected to said feed valve, at least one compressor having at least one compression chamber, and at least one inlet valve which is connected to said feed line and to said compression chamber, said feed valve having an open position wherein air can pass through said valve and a closed position wherein air is prevented from passing through said feed valve, said inlet valve having an open position wherein air can pass through said inlet valve and a one-way position wherein air can pass through said inlet valve in one direction only, wherein said feed valve is in its open position and said inlet valve is in its one-way position when said compressed-air supply installation is in said normal operating mode, thereby allowing air to enter said installation through said feed valve and said feed line, and to pass from said feed line through said inlet valve into said compression chamber, and wherein said feed valve is in its closed position and said inlet valve is in its open position when said installation is in said idling mode, thereby allowing air to pass back and forth between said feed line and said compression chamber.

15. The compressed-air supply installation of claim 14 wherein said feed line includes a feed chamber.

16. The compressed-air supply installation of claim 14 wherein said feed line has a predetermined volume.

17. The compressed-air supply installation of claim 14 further comprising a branch line branching off from said feed line downstream of said feed valve to a switch valve which is in a closed position in said normal operating mode and in a throttling position in said idling mode, said throttling position allowing a restricted flow of air into or out of said installation through said branch line.

18. The compressed-air supply installation of claim 17 wherein said switch valve directs air entering and exiting said installation through a crankcase of said compressor.

19. The compressed-air supply installation of claim 14 further comprising a branch line branching off from said feed line downstream of said feed valve to a switch valve which is in a closed position in said normal operating mode and in a regulating one-way position in said idling mode, said regulating one-way position of said switch valve allowing air to pass from said feed line through said branch line and to exit from said installation when the pressure in said feed line rises above a predetermined value and allowing air to pass freely from the atmosphere into said feed line through said branch line.

20. The compressed air supply installation of claim 19 wherein said switch valve directs air entering and exiting said installation through a crankcase of said compressor.

21. The compressed air supply installation of claim 14 further comprising a branch line branching off from said feed line downstream of said feed valve to a switch valve which is in a closed position in said normal operating mode and in a one-way throttling position in said idling mode, said one-way throttling position restricting the flow of air exiting said installation through said branch line while allowing an unobstructed reverse flow of air to enter said installation through said branch line.

22. The compressed air supply installation of claim 21 wherein said switch valve directs air entering and exiting said installation through a crankcase of said compressor.

23. The compressed air installation of claim 14, further comprising a branch line branching off from said feed line downstream of said feed valve which has a throttling effect allowing a restricted flow of air into or out of s aid installation through said branch line.

24. The compressed air installation of claim 23, wherein said throttling effect is provided by a throttle which is installed within or after said branch line.

25. The compressed air installation of claim 23, further comprising a check valve connected to said feed line downstream of said feed valve, wherein said check valve allows air to enter into said feed line.

26. The compressed air supply installation of claim 14, further comprising a branch line branching off from said feed line downstream of said feed valve and a check valve which follows said branch line, or is installed within said branch line, wherein said check valve allows air to enter said installation through said branch line.

27. The compressed air installation of claim 26, further comprising a one way valve with predetermined opening pressure, connected to said feed line downstream of said feed valve, wherein said one way valve allows air to exit said installation at said feed line when the pressure in said feed line reaches said opening pressure.

28. The compressed air supply installation of claim 26, further comprising a one way valve with predetermined opening pressure which by-passes said feed valve, said one way valve allowing air from downstream of said feed valve to flow towards upstream of said feed valve when the pressure in said feed line downstream of said feed valve reaches said opening pressure.

29. The compressed air installation of claim 14, further comprising a branch line branching off from said feed line downstream of said feed valve and a one way valve with predetermined opening pressure which follows said branch line or is installed within said branch line, wherein said one way valve allows air to exit said branch line when the pressure in said feed line reaches said opening pressure.

30. The compressed air supply installation of claim 29, further comprising a check valve connected with said feed line downstream of said feed valve which allows air to enter said installation at said feed line.

31. The compressed air installation of claim 14, wherein an end of said branch line towards the atmosphere lets out into the crankcase of said compressor which is connected to the atmosphere.

* * * * *